United States Patent [19]

Hislop et al.

[11] 4,433,314

[45] Feb. 21, 1984

[54] MILLIMETER WAVE SUSPENDED SUBSTRATE MULTIPLEXER

[75] Inventors: Alfred R. Hislop; David Rubin, both of San Diego, Calif.

[73] Assignee: The United States of America as represented by the Secretary of the Navy, Washington, D.C.

[21] Appl. No.: 341,357

[22] Filed: Jan. 21, 1982

[51] Int. Cl.[3] ..... H01P 1/213

[52] U.S. Cl. ..... 333/110; 333/116; 333/204; 333/246

[58] Field of Search ..... 333/110, 116, 204, 126, 333/238, 246

[56] References Cited

U.S. PATENT DOCUMENTS

| | | | |
|---|---|---|---|
| 2,922,123 | 1/1960 | Cohn | 333/110 |
| 3,135,935 | 6/1964 | Engelbrecht | 333/238 |
| 3,772,616 | 11/1973 | Imoto | 333/116 X |
| 4,029,902 | 6/1977 | Bell, Jr. et al. | 333/110 X |
| 4,159,454 | 6/1979 | Willmore | 333/110 X |
| 4,210,881 | 7/1980 | Rubin | 333/110 |

OTHER PUBLICATIONS

Weir et al., *Wideband Multiplexers Using Directional Filters,* Microwaves, May 1969, vol. 8, No. 5, pp. 44–50.

*Primary Examiner*—Paul L. Gensler

*Attorney, Agent, or Firm*—Robert F. Beers; Ervin F. Johnston; Harvey Fendelman

[57] ABSTRACT

A millimeter wave suspended substrate multiplexer is disclosed which is comprised of a plurality of hybrid-filter-hybrid channel dropping sections. The components of the multiplexer are enclosed in a metallic housing forming a cavity surrounding the multiplexer components. Each of the hybrid-filter-hybrid sections is comprised of first and second 90° hybrid couplers which are connected by a pair of identical bandpass filters. Spurious waveguide energy propagation modes which would otherwise be generated in the cavity surrounding the 90° suspended hybrid couplers are eliminated by the use of a plurality of mode suppression pins extending between the top and bottom portions of the metallic housing and passing through the branch lines of the couplers.

13 Claims, 2 Drawing Figures

MILLIMETER WAVE SUSPENDED SUBSTRATE MULTIPLEXER

BACKGROUND OF THE INVENTION

The present invention relates generally to the field of multiplexers and also generally to the field of mode suppression mechanisms. More particularly, the present invention relates to channelized down converters and to mechanisms for suppressing spurious propagation modes in the vicinity of 90° suspended substrate hybrid couplers.

Channelized down converter techniques are finding increased use in surveillance receivers, especially at millimeter-wave frequencies where extremely wide bandwidths must be covered. Wideband mixers with switched or swept local oscillators have been used, but these systems are limited to an instantaneous bandwidth equal to the down converted IF bandwidth and also suffer from lack of image rejection. The key front-end component of the channelized down converter is the RF multiplexer. Millimeter wave multiplexers have been demonstrated previously in microstrip and finline structures. A major problem with these prior art fin line multiplexers has been the large amount of space required by them.

SUMMARY OF THE INVENTION

In accordance with the present invention, a very compact, low-loss, low-cost multiplexeer for sorting millimeter wave signals according to frequency is disclosed. Further, a mechanism is disclosed for eliminating or at least reducing spurious waveguide energy propagation modes which may be present in the operation of 90° suspended substrate hybrid couplers. The multiplexer of the present invention may be the key element in the front end of wideband receivers used for electronics warfare surveillance and warning systems. The present invention utilizes integrated suspended substrate filters, couplers and loads, all constructed within the same structure. This construction has resulted in a volume reduction by a factor of 100 as compared to the smallest related fin line device and has also resulted in better overall performance.

In accordance with the present invention a plurality of hybrid-filter-hybrid sections are formed on a suspended dielectric substrate enclosed within a metallic housing forming a cavity around the planar components. Each hybrid-filter-hybrid is comprised of two 3db 90° hybrid couplers, one on each side of a pair of identical parallel coupled bandpass filters. Holes are drilled in the dielectric substrate between the branch lines of the 3db couplers and metal pins are passed through these holes and in contact with at least a portion of the metallic housing to provide for spurious mode suppression.

The present invention thus provides for a great reduction in size over previous millimeter wave multiplexers. Also, a great reduction in cost may be realized with the present invention due to the fact that printed circuit techniques may be utilized.

OBJECTS OF THE INVENTION

Accordingly, it is the primary object of the present invention to disclose a millimeter wave multiplexer constructed in the suspended substrate medium.

It is a further object of the present invention to disclose a multiplexer having greatly reduced size.

It is another object of the present invention to disclose a mode suppression mechanism for use with suspended substrate hybrid couplers.

These and other objects of the invention will become more readily apparent from the ensuing specification when taken together with the drawings.

DESCRIPTION OF THE PREFERRED EMBODIMENT

Figure 1:
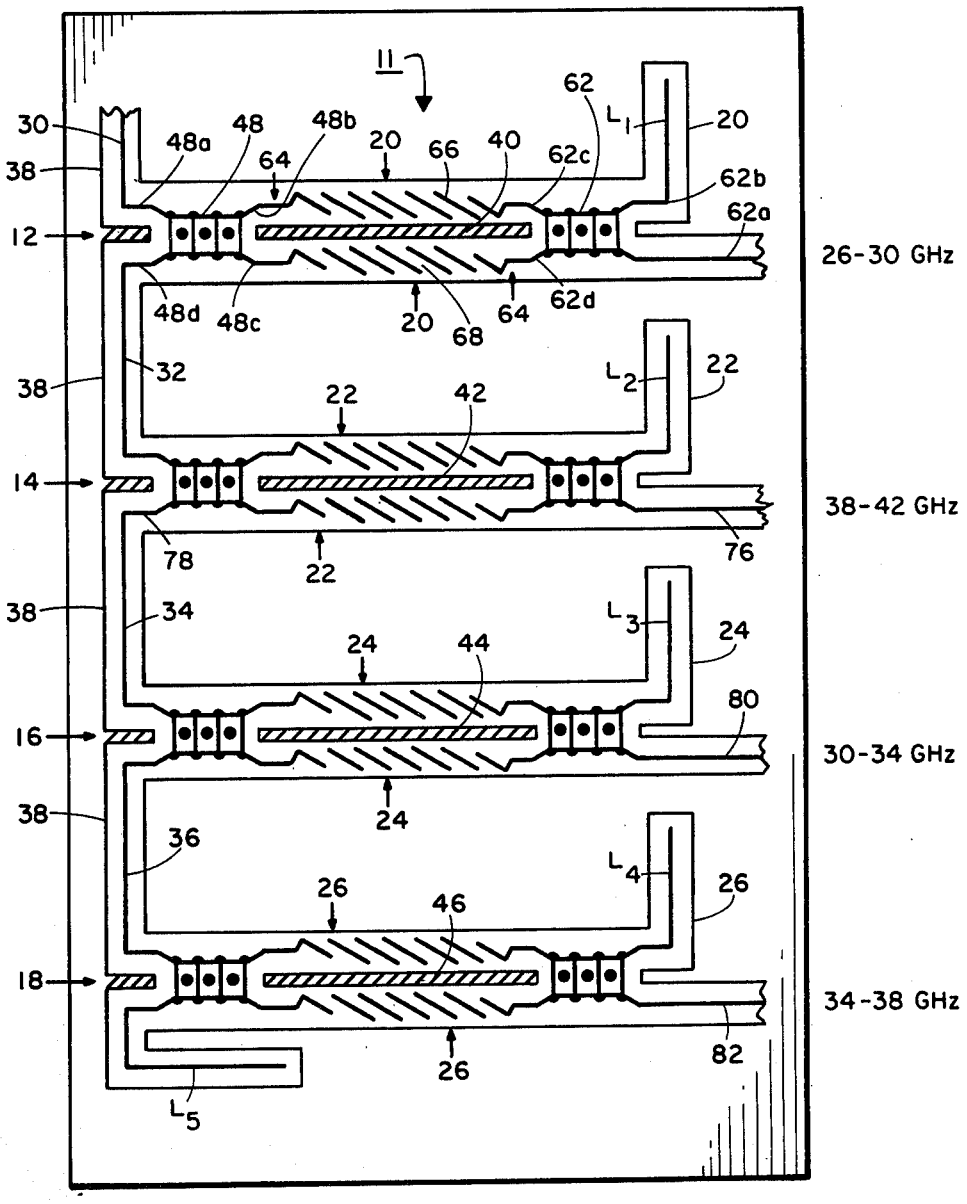
FIG. 1 is a top view of the multiplexer circuit pattern in accordance with the present invention.
Figure 2:
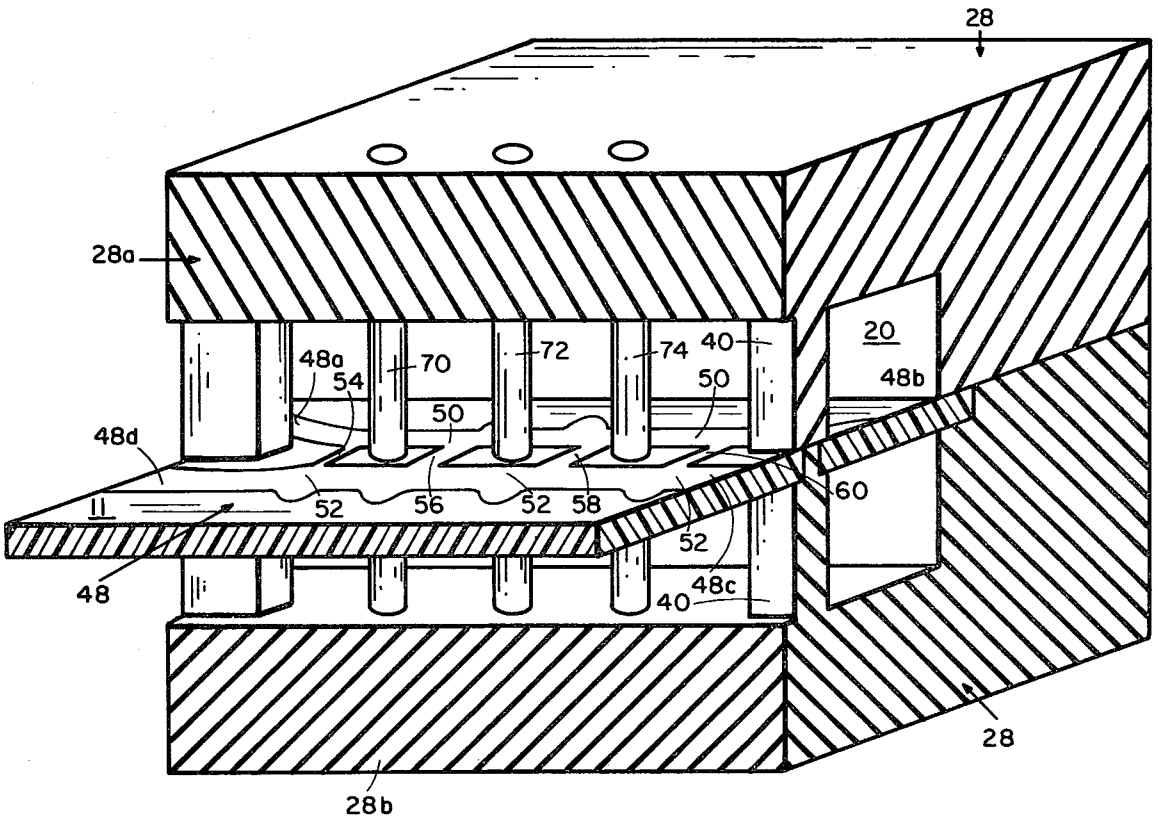
FIG. 2 is a partially cutaway perspective view of a portion of the present invention illustrating the mode suppression mechanism and a portion of the metallic housing of the present invention.

Referring now to FIGS. 1 and 2, the construction and operation of the present invention will be described. The multiplexer pattern of the suspended substrate millimeter wave multiplexer of the present invention is formed on a dielectric substrate 11 which may be, for example, irradiated polyolefin or glass fiber impregnated "Teflon" available under the trade name "Duroid". The multiplexer circuit pattern illustrated in FIG. 1 is comprised of a plurality of hybrid-filter-hybrid sections 12, 14, 16 and 18. It is to be understood that although the present invention is described and illustrated in this application as including four hybrid-filter-hybrid sections, either fewer or a greater number of channel dropping filter sections may be utilized depending upon the application requirements. The circuit pattern illustrated in FIG. 1 on the dielectric substrate 11 is photolithographically reproduced on the substrate 11 which is then suspended in metal wall channels 20, 22, 24 and 26 it being understood that the periphery only of the channels are illustrated in FIG. 1. Referring to FIG. 2 a portion of channel 20 formed by the metallic housing 28 is shown in greater detail for purposes of illustration. Likewise, the input lines 30, 32, 34 and 36 are enclosed in a cavity 38 formed by metallic walls the periphery of which is illustrated in FIG. 1. The dimensions of the cavities or channels 20, 22, 24, 26 and 38 are designed to be too small to propagate waveguide modes at the frequencies of operation. In order to reduce the channel dimensions, metallic walls 40, 42, 44 and 46 are placed within each of the channel dropping filter sections 12, 14, 16 and 18 as illustrated. A portion of the metallic wall 40 is illustrated in more detail in FIG. 2 for purposes of clarity.

Each of the channel dropping filters 12, 14, 16 and 18 is comprised of two 3db 90° hybrid couplers connected by dual bandpass filters as will be described. Since all of the channel dropping filters of the multiplexer are essentially identical except for the frequency passbands of the filter sections of the channel dropping filters, only channel 12 will be described, it being understood that the remaining channels are substantially identical. Hybrid-filter-hybrid section 12 is comprised of a first hybrid coupler 48. Hybrid coupler 48 is illustrated in more detail in FIG. 2. Hybrid coupler 48 is comprised of two substantially parallel outer branch lines 50 and 52. The spaced, outer branch lines 50 and 52 are connected by inner branch lines 54, 56, 58 and 60 as illustrated. The 3db 90° hybrid coupler 62 is identical to hybrid coupler 48 and therefore no further description is necessary. A bandpass filter generally referred to as 64 connects the two hybrid couplers 48 and 62. The bandpass filter 64 is comprised of identical edge or parallel coupled filters 66 and 68 which, in the present example, are designed to pass signals within the frequency range of 26 to 30 GHz and to reject signals outside of that frequency band.

Referring to FIG. 2 it is seen that three mode suppression pins 70, 72 and 74 extend between the top portion 28*a* and the bottom portion 28*b* of the metal housing 28 and that the mode suppression pins 70, 72 and 74 extend through the dielectric substrate in the spaces between the inner branch lines 54, 56, 58 and 60 of the hybrid coupler 48. Similarly, each of the hybrid couplers in the multiplexer circuit have mode suppression pins extending from the top portion 28*a* to the bottom portion 28*b* of the metallic housing 28 and through the dielectric substrate 11.

In the particular embodiment of the present invention illustrated by way of example, the input frequency range is 26 to 42 GHz. It is again noted that the present invention may be used at other bands of frequencies and that the frequencies illustrated and discussed herein are by way of example only. Each channel dropping filter 12, 14, 16 and 18 passes a range of frequencies determined by its identical bandpass filters and rejects all other frequencies, passing the rejected signals to the next lower section. More particularly, the present invention operates as follows. It should be understood at this point that each 90° hybrid coupler of the present invention is a 4-port device having a first port such as port 48*a* of hybrid coupler 48, two ports such as output ports 48*b* and 48*c* and another port such as port 48*d* all illustrated in FIG. 2. Further, for purposes of this invention each channel dropping filter section 12, 14, 16 and 18 is considered to be a 4-port section having an input port such as input port 48*a* of hybrid coupler 48, a signal pass output port such as output port 62*a* of hybrid coupler 62, a loaded port such as port 62*b* of hybrid coupler 62, which is connected to load L1 and signal reject output port such as output port 48*d* of hybrid coupler 48. It should also be understood that each of the 90° hybrid couplers of the present invention operates in conventional manner such that any signal received by its input port is divided equally between its two output ports with a 90° phase shift between the output signals on the output ports.

Assuming an input signal in the 26 to 42 GHz frequency band is received on input line 30, such signal will be divided equally by the hybrid coupler 48 between its two output ports 48*b* and 48*c*. The components of this signal that are within the 26 to 30 GHz band will be passed by the identical parallel coupled filters 66 and 68 to the two ports 62*c* and 62*d* of the hybrid coupler 62. These signals will combine in phase at the output port 62*a* and will combine 180° out of phase at the loaded port 62*b*. Thus, any signal which is passed by both identical filters 66 and 68 will appear at the output port 62*a*. Any signal which is rejected by the filters 66 and 68 recombines out of phase at the input port 48*a* and in phase at the signal reject port 48*d* thereby propagating down to the next lower channel 14. Similarly, channel dropping filter section 14 will pass any signals in the frequency range of 38 to 42 GHz to its output port 76 and will pass signals it receives which are not in the frequency band of 38 to 42 GHz to its signal reject output port 78. Likewise, the remaining channel dropping filter sections 16 and 18 pass the components of the input signal that are within the passband of frequencies of their respective passband filter sections. Thus, channel dropping filter section 16 will pass the components of the input signal within the 30 to 34 GHz band of frequencies to its output port 80 and will reject all signals not within the passband of the bandpass filters of the channel dropping section 16. Likewise channel dropping filter section 18 will pass those components of the input signal in the frequency band 34 to 38 GHz to its output port 82 and will reject signal components not within that band of frequencies. Finally, any signal components which are rejected by all of the channel dropping filters will go to the load $L_5$.

Referring to FIG. 2 it is seen that due to the particular construction of the 3db 90° hybrid coupler 48, as well as each of the other hybrid couplers of the multiplexer of the present invention, it is not possible to reduce the channel width of the channels such as channel 20 in the area of the hybrid couplers as by insertion of a metallic wall 40 between the extremeties of the cavity 20. Due to this, the channel 20 is more than twice as wide in the area of the hybrid couplers as it is around the other portions of the printed circuit of the multiplexer. Due to this width of the channel in the area of the hybrid couplers, spurious waveguide energy propagation modes can be supported in the area of the hybrid coupler 48 as well as in the area of each of the other hybrid couplers of the multiplexer of the present invention. It is noted at this point that the channel dimensions in the other portions of the multiplexer are designed to be too narrow to support waveguide energy propagation modes. In order to suppress these spurious propagation modes in the vicinity of the hybrid couplers, the mode suppression pins such as the pins 70, 72 and 74 used with respect to hybrid coupler 48 are used with respect to each of the hybrid couplers of the multiplexer of the present invention. By inclusion of such mode suppression pins, the effective channel width is reduced and spurious waveguide propagation modes are prevented.

Obviously, many modifications and variations of the present invention are possible in the light of the above teachings. It is therefore to be understood that within the scope of the appended claims the invention may be practiced otherwise than as specifically described.

What is claimed is:

1. A multiplexer for separating the components of a signal having signal components in N bands of frequencies comprising:

a dielectric substrate;

first means disposed on said substrate for receiving a signal including signal components within at least one of N bands of frequencies;

N suspended substrate channel dropping filters disposed on said dielectric substrate each having an input port, a signal pass output port and a signal reject output port, a first one of said N channel dropping filters having its input port operably coupled to said first means and each of the remaining N−1 channel dropping filters having its input port operably coupled to the signal reject output port of one of the other N−1 channel dropping filters;

a metallic housing forming a cavity surrounding said dielectric substrate, said first means and said N channel dropping filters;

each of said N channel dropping filters comprising:

a first hybrid coupler;

a bandpass filter operably coupled to said first hybrid coupler;

a second hybrid coupler operably coupled to said bandpass filter;

each of said bandpass filters comprising first and second substantially identical edge-coupled filters;

said metallic housing having a top portion and a bottom portion; and each pair of said first and second substantially identical edge-coupled filters having a metallic wall positioned between first and second edge-coupled filters and extending between said metallic housing top and bottom portions.

2. The multiplexer of claim 1 wherein said first means comprises a planar transmission line.

3. The multiplexer of claims 1 or 2 wherein each of said channel dropping filters has a loaded port.

4. The multiplexer of claim 1 wherein:

each of said first and second hybrid couplers comprises a 90° hybrid coupler.

5. The multiplexer of claim 4 wherein:

each of said second 90° hybrid couplers has a loaded port.

6. The multiplexer of claim 4 further comprising:

a plurality of means for suppressing spurious energy propagation modes, each being positioned in the vicinity of one of said 90° hybrid couplers.

7. The multiplexer of claim 6 wherein:

said metallic housing has a top portion and a bottom portion; and each of said suppressing means comprises at least one metallic pin extending between said top and bottom portions, through said dielectric substrate and through one of said 90° hybrid couplers.

8. The multiplexer of claim 6 wherein:

said metallic housing has a top portion and a bottom portion; and each of said suppressing means comprises three metallic pins extending between said top and bottom portions, through said dielectric substrate and through one of said 90° hybrid couplers.

9. The multiplexer of claim 4 wherein each of said 90° hybrid couplers comprise:

first and second substantially parallel, planar transmission lines disposed on said substrate; and first, second, third and fourth substantially parallel, spaced transmission lines extending between said first and second substantially parallel, planar transmission lines.

10. The multiplexer of claim 9 further comprising:

a plurality of means for suppressing spurious energy propagation modes, each being positioned in the vicinity of one of said 90° hybrid couplers.

11. The multiplexer of claim 10 wherein:

said metallic housing has a top portion and a bottom portion; and each of said suppressing means comprises at least one metallic pin extending between said top and bottom portions, through said dielectric substrate and through one of said 90° hybrid couplers.

12. The multiplexer of claim 10 wherein:

said metallic housing has a top portion and a bottom portion; and each of said suppressing means comprises three metallic pins extending between said top and bottom portions, through said dielectric substrate and through one of said 90° hybrid couplers.

13. The multiplexer of claim 12 wherein:

each of said three metallic pins extends through said substrate in the space between one pair of said first, second, third and fourth substantially parallel, spaced transmission lines.

* * * * *